US006474542B1

(12) United States Patent
Chagnon et al.

(10) Patent No.: US 6,474,542 B1
(45) Date of Patent: Nov. 5, 2002

(54) CARTON WITH FRAMED OPENING FEATURE AND PRODUCT VIEWING WINDOW

(75) Inventors: Nichole M. Chagnon, Whitefish Bay; Karl A. Kohler, Bartlett; Ian P. Hunter, Milwauee County, all of WI (US)

(73) Assignee: S. C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 09/615,088

(22) Filed: Jul. 12, 2000

(51) Int. Cl.[7] ..... B65D 17/28; B65D 25/54

(52) U.S. Cl. ..... 229/242; 229/162; 229/237

(58) Field of Search ..... 229/162, 237, 229/242; 221/302; 428/43, 136

(56) References Cited

U.S. PATENT DOCUMENTS

| | | | | |
|---|---|---|---|---|
| 1,539,523 A | | 5/1925 | Spraggins | |
| 3,207,411 A | | 9/1965 | Farquhar | |
| 3,237,842 A | | 3/1966 | Esse | |
| 3,325,003 A | | 6/1967 | Bilezerian | 206/57 |
| 3,326,364 A | * | 6/1967 | Waldrop et al. | 229/237 |
| 3,620,438 A | * | 11/1971 | Wood et al. | 229/237 |
| 3,647,114 A | | 3/1972 | Bleuer | 221/59 |
| 3,814,236 A | | 6/1974 | Keilman | 206/72 |
| 4,163,508 A | * | 8/1979 | Mannor | 229/242 |
| 4,419,373 A | | 12/1983 | Oppermann | 426/234 |
| 4,447,044 A | | 5/1984 | House et al. | |
| 4,630,735 A | * | 12/1986 | Jebens | 229/242 |
| 4,676,430 A | * | 6/1987 | Wischusen, III et al. | 229/242 |
| 4,821,951 A | * | 4/1989 | Franzoni | 229/162 |
| 4,997,105 A | | 3/1991 | Fischer | 221/45 |
| 5,060,853 A | * | 10/1991 | Gulliver et al. | 229/162 |
| D360,131 S | | 7/1995 | Tudor | D9/418 |
| 5,540,354 A | | 7/1996 | Annand | 221/52 |

OTHER PUBLICATIONS

Example of packaging from "Kleenex", manufactured by Kimberly–Clark Corporation, Neenah, WI, copyright notice 1938, 1986, 1996.

Example of packaging from "Barilla Oven Ready Lasagna", distributed by Barilla America, Inc., Lincolnshire, IL.

Example of packaging from "America's Choice Heavy Duty Forks", distributed by Compass Foods, Montvale, NJ.

Example of packaging from "Hostess Powdered Donettes", distributed by Interstate Brands Companies, Kansas City, MO, copyright notice 1997.

Example of packaging from "Creamette Brand Elbow Macaroni", Creamette Borden, Inc., Columbus, OH.

Example of packaging from "American Beauty Spaghetti", manufactured by Hershey Pasta Group, Hershey, PA.

Example of packaging of "Ziploc Slide Loc Bags", manufactured by S.C. Johnson & son, Inc., Racine, WI, copyright notice 1998.

Example of packaging of "Smucker's Snacker's Lunchbox", manufactured by the J.M. Smucker Co., Orrville, OH.

Example of packaging of "Entenmann's Donuts", Entenmanns, Inc., Totowa, NJ, copyright notice 2000.

* cited by examiner

*Primary Examiner*—Gary E. Elkins

(57) ABSTRACT

A carton includes a first wall, a second wall transverse to the first wall, a weakened section in the first wall defining a framed removable portion and a framed opening in the second wall. A sheet of non-opaque material may cover at least a portion of the framed opening in the second wall.

25 Claims, 5 Drawing Sheets

CARTON WITH FRAMED OPENING FEATURE AND PRODUCT VIEWING WINDOW

TECHNICAL FIELD

The present invention relates generally to packaging, and, more particularly, to a carton for a dispensable product.

BACKGROUND OF THE INVENTION

Many products require a carton or other enclosure to protect the product and keep the product elements together during shipment and delivery to the consumer. In addition, it is desirable for the carton to be inexpensive to manufacture and erect and yet still be sturdy enough to withstand the rigors of shipment and provide a high level of convenience to the consumer.

In some retail applications, for example, where disposable. thermoplastic bags are sold at retail, a large number of different brands are typically available and are not readily differentiated by the consumer. Accordingly, a need exists for a package which allows the consumer to easily identify the type of product contained in the package.

Additionally, packaging is often designed to facilitate dispensing of product to the consumer. For example, a tissue carton. typically includes a dispensing feature (referred to hereinafter for the sake of convenience as a "framed opening feature") on a top wall thereof. The framed opening feature typically comprises a series of perforated scores spaced from edges of the top wall and which define a marginal edge of a removable panel. A tab is also usually formed as part of the removable panel and the tab may be grasped by a consumer and pulled upwardly to separate the removable panel from the carton. In some tissue cartons, a plastic liner is adhered to an inside surface of the top wall and the liner includes a slit that accommodates the passage of tissue sheets therethrough.

U.S. Pat. No. 3,647,114 discloses a tissue carton having a framed opening feature in a top wall and a slot in side and bottom walls. of the carton. A resilient band is secured to the carton and extends through the slot into contact with a supply of tissue sheets in the box to urge the supply upwardly for presentation to the consumer through the framed opening feature.

SUMMARY OF THE INVENTION

In accordance with one aspect of the present invention, a carton includes a first wall, a second wall transverse to the first wall, a weakened section in the first wall defining a framed removable portion and a framed opening in the second wall.

Preferably, the carton further includes a plastic sheet overlying at least a portion of the framed opening wherein the plastic sheet is transparent. Still further in accordance with the preferred embodiment, the plastic sheet is formed of polypropylene which is approximately 2 mils thick. Also, the plastic sheet may be adhered to a marginal portion wherein the marginal portion completely surrounds the framed opening.

In addition, the first wall is preferably a top wall and the second wall is preferably a side wall. Still further, the framed removable portion may be defined by staggered offset perforations and each perforation may be approximately $1/8^{th}$ inch long and offset from an adjacent perforation by approximately $1/8^{th}$ inch.

Also in accordance with the preferred embodiment, the carton is of a seal end type.

In accordance with another aspect of the present invention, a carton comprises a top wall, a pair of side walls transverse to the top wall, a bottom wall opposite the top wall and a pair of end walls transverse to the top wall, the side walls and the bottom wall. Staggered offset perforations are disposed in the top wall defining a framed removable potion. In addition, a framed opening is disposed in one of the walls transverse to the top wall and a non-opaque sheet overlies at least a portion of the second framed opening.

In accordance with yet another aspect of the present invention, a carton of the full seal end type includes a top wall, a pair of side walls transverse to the top wall, a bottom wall opposite the top wall and a pair of end walls transverse to the top wall, the side walls and the bottom wall. Staggered offset perforations are disposed in the top wall defining a first framed opening wherein each perforation is approximately $1/8^{th}$ inch long and is offset from an adjacent perforation by approximately $1/8^{th}$ inch. A second framed opening is disposed in one of the side walls and a transparent sheet of polypropylene approximately 2 mils thick is adhered to a marginal portion of an inner surface of the one side wall completely surrounding the second framed opening.

Other aspects and advantages of the present invention will become apparent upon consideration of the following detailed description.

DESCRIPTION OF THE PREFERRED EMBODIMENTS

Figure 1:
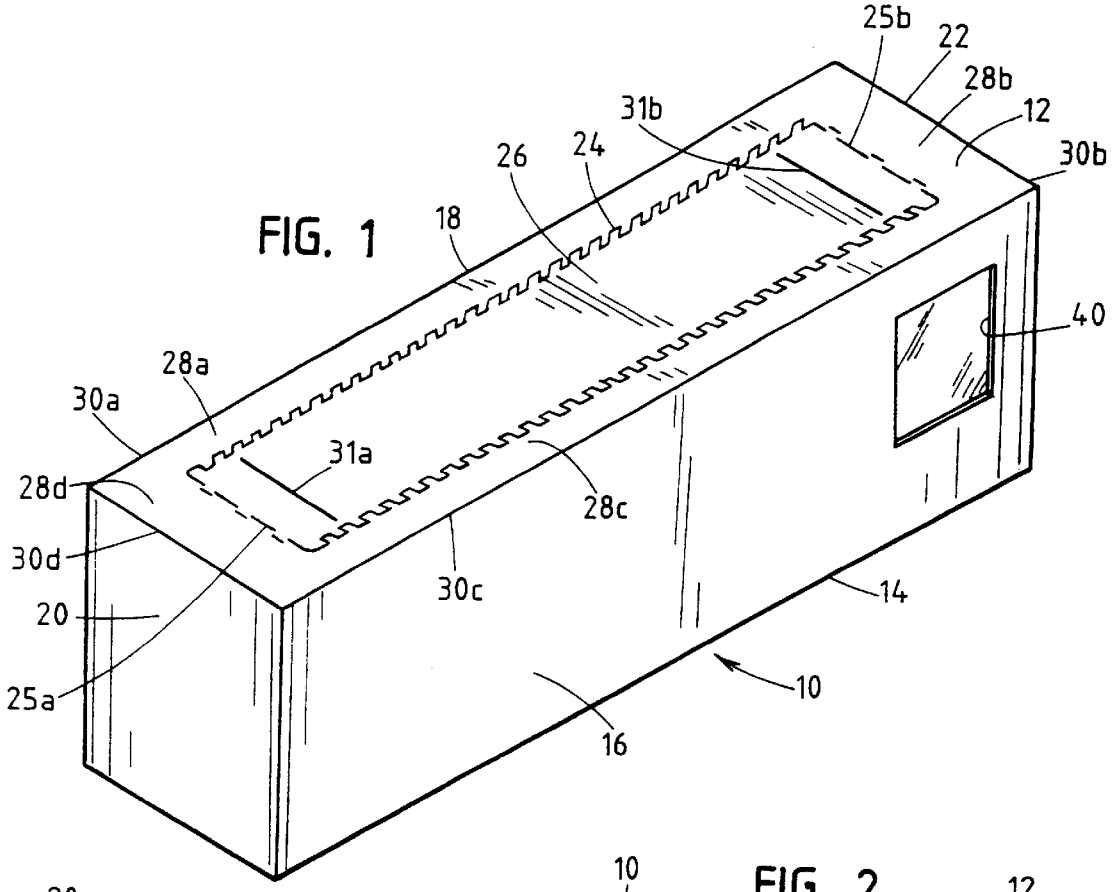
FIG. 1 comprises an isometric view of a carton according to the present invention.
Figure 2:
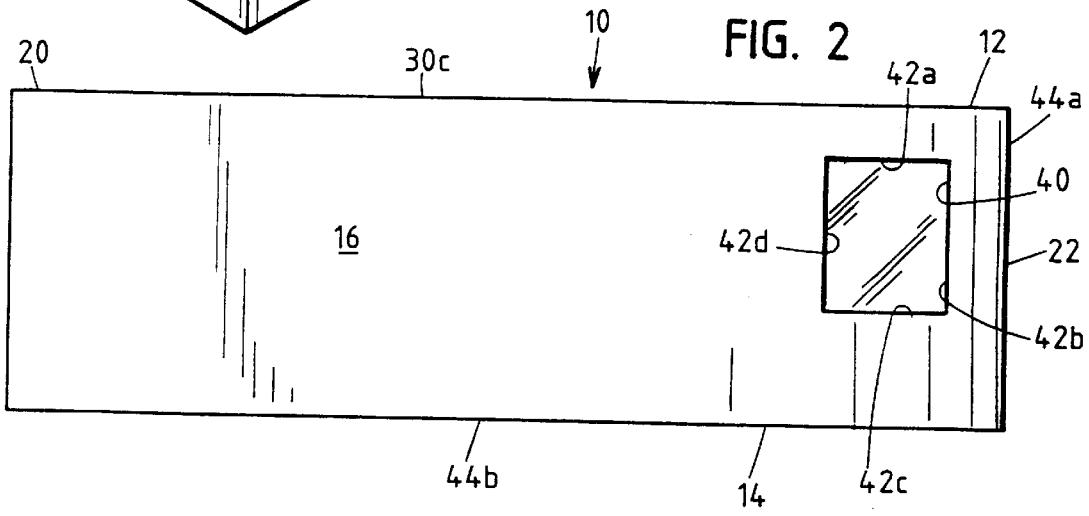
FIG. 2 comprises a front elevational view of the carton of FIG. 1.
Figure 3:
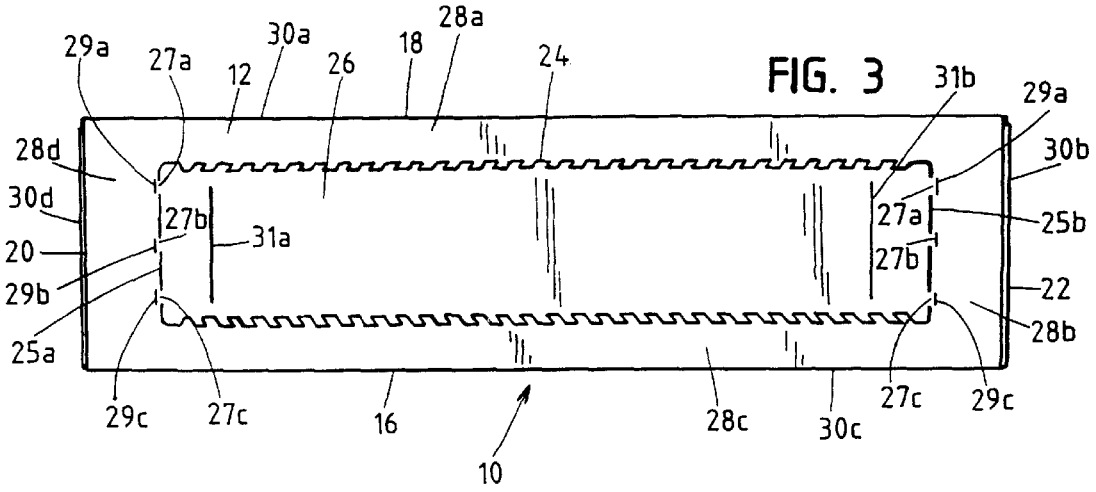
FIG. 3 comprises a plan view of the carton of FIG. 1.

Referring now to FIGS. 1–3, a carton 10 includes a top wall 12, a bottom wall 14 opposite the top wall 12, a pair of side walls 16, 18 transverse to the top and bottom walls 12, 14 and a pair of end walls 20, 22 transverse to the walls 12, 14, 16, 18. In the preferred embodiment, the walls 12 and '14 are perpendicular to the walls 16–22, although this need not be the case.

The top wall 12 preferably includes a top opening feature afforded by a series of staggered offset perforations 24 and end perforations 25*a*, 25*b*, which together create a weakened section defining a framed removable portion 26. The term "framed" as used herein is intended to refer to a structure or opening of or in a surface or wall wherein the structure or opening is spaced from marginal edges defining the surface or wall. Thus, the framed removable portion 26 is surrounded by portions 28*a*, 28*b*, 28*c* and 28*d* of the top wall 12 bounded by marginal edges 30*a*, 30*b*, 30*c* and 30*d*. Preferably, the perforations 24 are all substantially parallel to the marginal edges 30*a* and 30*c*, although this need not be the case. Also, adjacent perforations 24 are joined by scored portions that are preferably (although not necessarily) disposed at a non-zero angle with respect to each of the marginal edges 30*a*–30*d*. Still further, each perforation 24 is preferably approximately ⅛ inch long and offset from adjacent perforations by approximately ⅛ inch. In addition, the perforations 24 are preferably no closer than approximately 0.444 inch to the adjacent marginal edge 30*a*, 30*c* to ensure that perforation integrity is maintained during set up of the carton 10. Preferably, each end perforation 25*a*, 25*b* is spaced approximately ¾ inch from the adjacent marginal edges 30*b*, 30*d*. As seen specifically in FIG. 3, the end perforations 25*a*, 25*b* are discontinuous in the sense that one or more unperforated portions 27*a*, 27*b*, 27*c* are disposed in intermediate portions of each end perforation 25*a*, 25*b*. Also, further perforations 29*a*, 29*b*, 29*c* are disposed at each intermediate portion offset from and parallel to the associated end perforation 25*a*, 25*b*.

First and second bar scores 31*a*, 31*b* are provided at opposite ends of the portion 26. The scores 31*a*, 31*b* together with the end perforations 25*a*, 25*b* and the further perforations 29*a*–29*c* form weakened sections at either end of the package 10 to permit the consumer to press either end of the portion 26 into the carton 10 and to pull the resulting flap upwardly to remove the portion 26 from the top wall 12. The grain of the board extends between the marginal edges 30*b* and 30*d*, and hence, only minimal tearing of the remaining sections of the top wall 12 occurs as a result of the removal process.

As further seen in FIGS. 1 and 2, a framed opening 40 is disposed in the side wall 16. If desired, one or more alternative or additional framed openings may be provided in one or more of the walls 12, 14, 16, 18, 20 and/or 22. The framed opening 40 is preferably (although not necessarily) approximately 1 7/16 inch in height and 1⅛ inch in width, and right-side and upper edges 42*a* and 42*b* of the opening 40 (as seen in FIGS. 1 and 2) are spaced approximately ½ inch from marginal edges 30*c* and 44*a*. Also, the opening 40 may be other than rectangular in shape and/or may have radiused corners.

Figure 4:
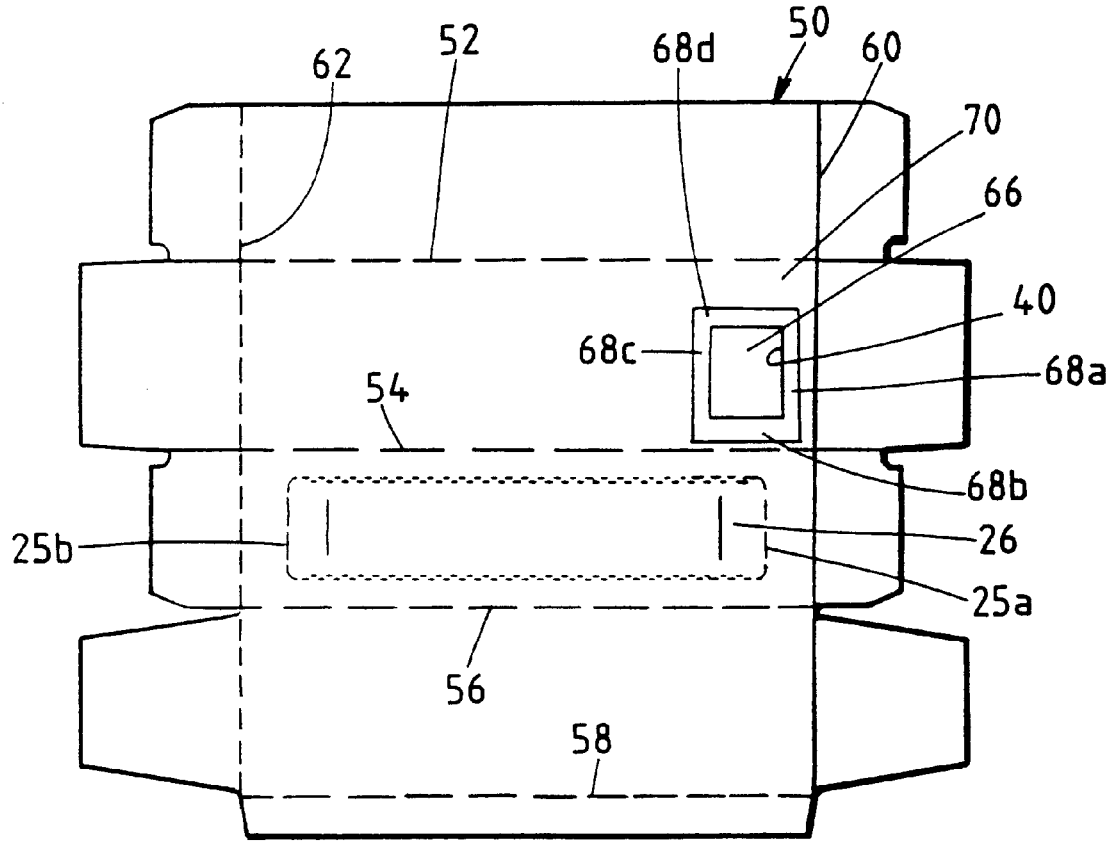
FIG. 4 is an elevational view of a blank used to form the carton of FIG. 1.

FIG. 4 illustrates a blank 50 fabricated of 18 point recycled board (a clay-coated newsback) which is erected and glued to form the carton 10 of the seal end type, and, preferably, of the full seal end type. The blank 50 is formed with combination perforation-scores 52, 54, 56, 58, 60 and 62 to assist in folding of the blank 50 to form the carton 10. As seen in FIG. 4, a sheet 66 of non-opaque material is secured by any suitable adhesive or other fastening means to marginal portions 68*a*–68*d* of an inner surface 70 of the blank 50 partially or completely surrounding the framed opening 40. In the preferred embodiment, the sheet 66 is fabricated of polypropylene approximately 2 mils thick and is approximately 2¼ inch in height and 2¼ inch in width and is substantially centered over the opening 40. The size of the sheet 66 should be selected such that the sheet 66 is large enough to ensure effective adhesion to the inner surface of the carton 10. If desired, any suitable plastic or other material which is translucent or transparent may instead be used for the sheet 66. The sheet 66 could be colored or tinted as desired, or left untinted and uncolored.

Figure 5:
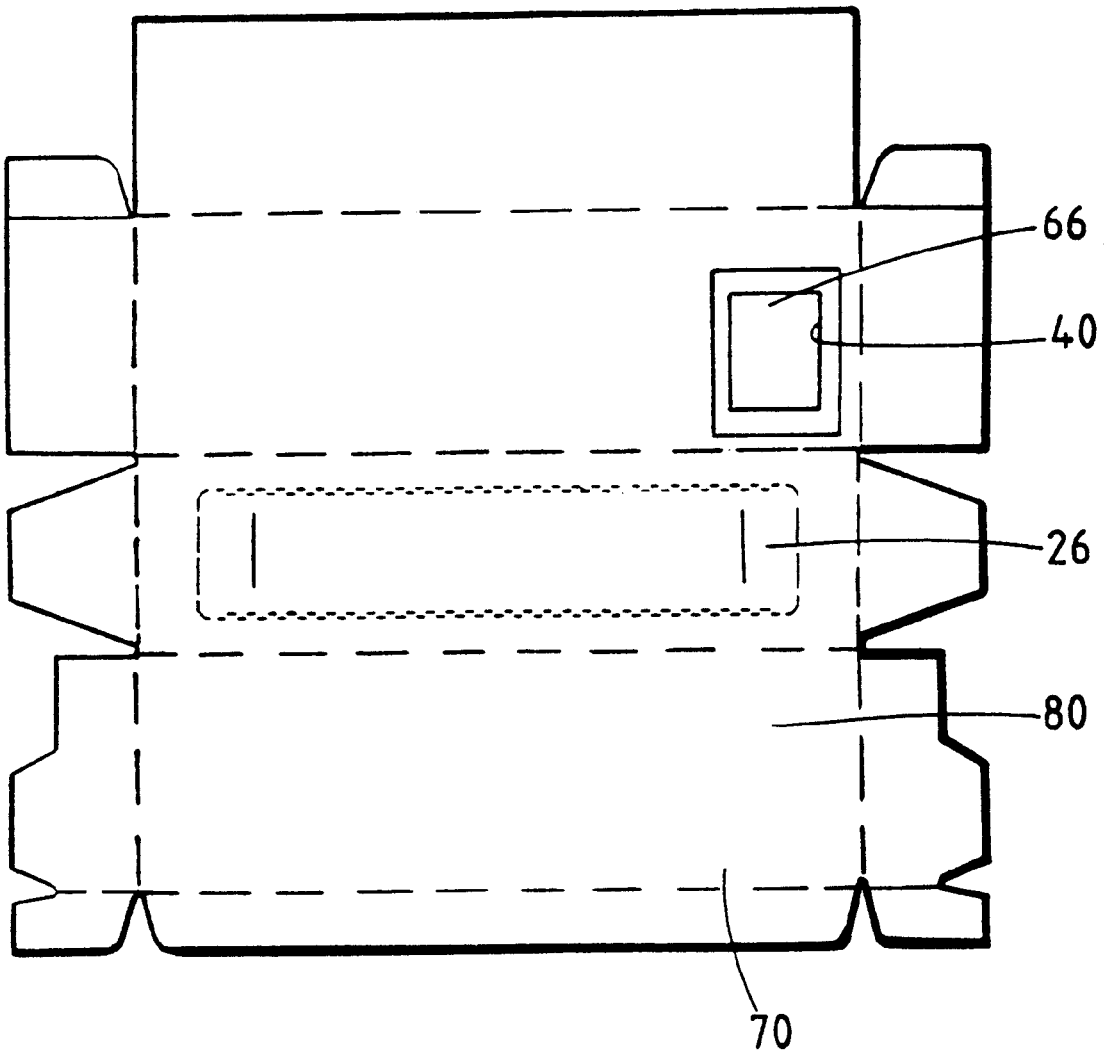
FIG. 5 is an elevational view similar to FIG. 4 illustrating a blank for forming a carton according to an alternative embodiment of the present invention.

Illustrated in FIG. 5 is an alternative blank 80 that may be erected to form the carton 10 (elements common to FIGS. 4 and 5 are assigned like reference numbers). The carton 10 in this configuration is referred to as being of the "Hamlet" type. The blanks 50 and 80 are available from Smurfit-Stone Corporation of Clayton, Mo.

Industrial Applicability

Figure 6:
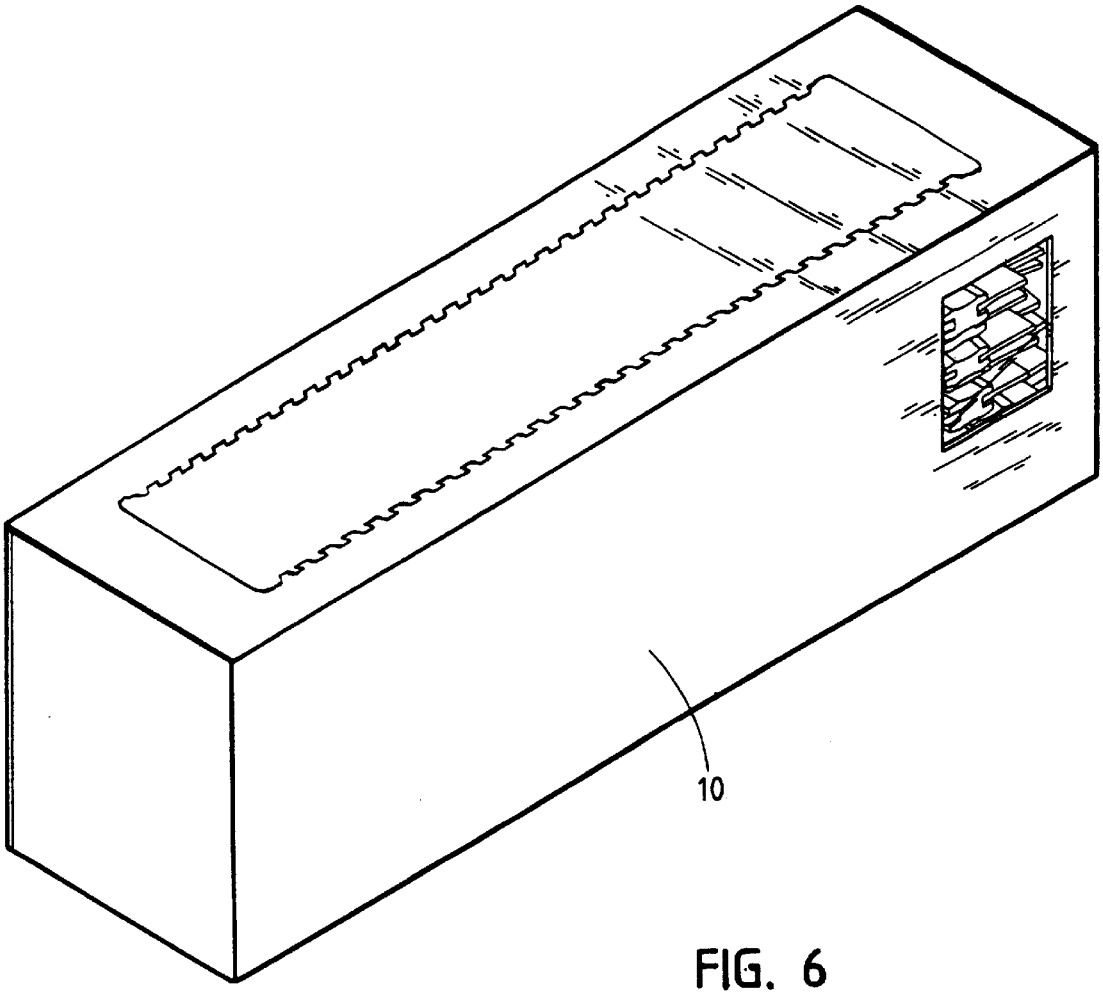
FIGS. 6 and 7 are views similar to FIGS. 1 and 2, respectively, illustrating the carton of the present invention with product disposed therein.
Figure 7:
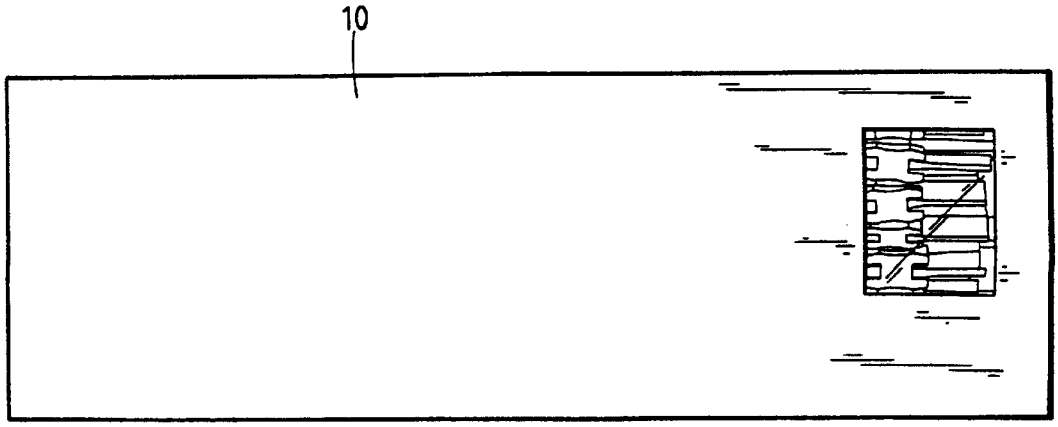

FIGS. 6 and 7 illustrate the carton 10 with product in the form of thermoplastic bags disposed therein. The carton 10 constructed in accordance with the present invention has the following advantages:

1. The carton 10 provides the consumer with a view of the product inside the carton on the store shelf;
2. The rectangular top opening feature provides easier, one-hand dispensing of the product;
3. The window afforded by the framed opening 40 is positioned and sized to maximize the view of the product without compromising the structural integrity of the carton 10 or the efficiency of the manufacturing process;
4. The rectangular top opening feature functions to accommodate most consumers' "home planograms" (i.e., where the consumer typically stores the carton) while utilizing the largest carton panel defined by walls 12–22 for shelf presence/market advertising;
5. The top opening feature includes the end perforations 25*a* and 25*b*, the further perforations 29*a*–29*c*, and the scores 31*a* and 31*b* to allow the consumer to easily open the carton 10 from either end using either hand and remove the entire framed removable portion 26 along the grain of the board. This arrangement minimizes jagged edges and fibers that are undesirable to the consumer and minimizes carton tearing on the outside surface of the top wall 12;
6. The carton 10 has a large opening size to dispense a product contained inside, such as one or more thermoplastic bags, while still maintaining a high degree of carton strength during such consumer use;
7. The spacing of the perforations 24 from the marginal edges 30*a* and 30*c* ensures perforation integrity during carton manufacture;
8. The carton 10 includes staggered offset perforations 24 which are parallel to the grain of the board to keep the fibers tearing in the desired direction during the opening process;
9. The window allows the consumer to see how much product is left in carton; and
10. The top opening feature permits complete removal of the portion 26 so that the consumer does not have to contend with a flap. In addition, the relatively clean edge along the opening of the carton 10 reduces the unpleasant sensation resulting from the rubbing of the consumer's hand against ragged edges of the carton 10.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A carton, comprising:

a first wall and a second wall transverse to the first wall;

a weakened section in the first wall defining a framed removable portion with staggered offset perforations; and a framed opening in the second wall.

2. The carton of claim 1, further including a plastic sheet overlying at least a portion of the framed opening.

3. The carton of claim 2, wherein the plastic sheet is transparent.

4. The carton of claim 3, wherein the plastic sheet is formed of polypropylene.

5. The carton of claim 4, wherein the plastic sheet is approximately 2 mils thick.

6. The carton of claim 5, wherein the plastic sheet is adhered to a marginal portion wherein the marginal portion completely surrounds the framed opening.

7. The carton of claim 1, wherein the first wall is a top wall and the second wall is a side wall.

8. The carton of claim 1, wherein each perforation is approximately $1/8^{th}$ inch long and is offset from an adjacent perforation by approximately $1/8^{th}$ inch.

9. The carton of claim 1, wherein the carton is of a seal end type.

10. The carton of claim 1, wherein the carton is of other than a full seal end type.

11. A carton, comprising:

a top wall, a pair of side walls transverse to the top wall, a bottom wall opposite the top wall and a pair of end walls transverse to the top wall, the side walls and the bottom wall;

staggered offset perforations in the top wall defining a framed removable portion;

a framed opening in one of the walls transverse to the top wall; and a non-opaque sheet overlying at least a portion of the framed opening.

12. The carton of claim 11, wherein the framed opening is disposed in one of the side walls and is disposed at least approximately ½ inch from a marginal edge of the one side wall.

13. The carton of claim 12, wherein the non-opaque sheet is transparent.

14. The carton of claim 13, wherein the non-opaque sheet is formed of polypropylene.

15. The carton of claim 14, wherein the non-opaque sheet is approximately 2 mils thick.

16. The carton of claim 11, wherein the non-opaque sheet is adhered to a marginal portion completely surrounding the framed opening.

17. The carton of claim 11, wherein the carton is of a full seal end type.

18. The carton of claim 11, wherein each perforation is approximately $1/8^{th}$ inch long and is offset from an adjacent perforation by approximately $1/8^{th}$ inch.

19. The carton of claim 18, wherein each perforation is disposed at least 0.444 inch from a marginal edge of the top wall.

20. The carton of claim 11, wherein the carton is of other than a full seal end type.

21. A carton of the seal end type, comprising:

a top wall, a pair of side walls transverse to the top wall, a bottom wall opposite the top wall and a pair of end walls transverse to the top wall, the side walls and the bottom wall;

staggered offset perforations in the top wall defining a first framed opening wherein each perforation is approximately $1/8^{th}$ inch long and is offset from an adjacent perforation by approximately $1/8^{th}$ inch;

a second framed opening in one of the side walls; and a transparent sheet of polypropylene approximately 2 mils thick and adhered to a marginal portion of an inner surface of the one side wall completely surrounding the second framed opening.

22. The carton of claim 21, wherein the second framed opening is disposed at least approximately ½ inch from a marginal edge of the one side wall.

23. The carton of claim 22, wherein each perforation is disposed at least 0.444 inch from a marginal edge of the top wall.

24. A carton, comprising:

a first wall and a second wall transverse to the first wall;

a weakened section in the first wall defining a framed removable portion with staggered offset perforations; and a framed opening in the second wall including a transparent plastic sheet formed of polypropylene approximately 2 mils thick overlying at least a portion of the framed opening.

25. The carton of claim 24, wherein the plastic sheet is adhered to a marginal portion herein the marginal portion completely surrounds the framed opening.

* * * * *